United States Patent [19]

Homer

[11] Patent Number: 4,886,043

[45] Date of Patent: Dec. 12, 1989

[54] GAS BURNER

[75] Inventor: David W. Homer, Tamworth, United Kingdom

[73] Assignee: Parkinson Cowan Ltd., Birmingham, United Kingdom

[21] Appl. No.: 243,952

[22] Filed: Sep. 13, 1988

[30] Foreign Application Priority Data

Sep. 16, 1987 [GB] United Kingdom ..... 8721743
Feb. 23, 1988 [GB] United Kingdom ..... 8804155

[51] Int. Cl.[4] ..... F24C 3/00

[52] U.S. Cl. ..... 126/39 R; 126/39 E; 431/195

[58] Field of Search ..... 126/39 R, 39 E, 15 R, 126/253, 251; 431/195, 350, 351

[56] References Cited

U.S. PATENT DOCUMENTS

| | | | |
|---|---|---|---|
| 3,825,404 | 7/1974 | DeGouville | 431/354 |
| 3,922,138 | 11/1975 | Biddle | 126/39 R X |
| 4,565,523 | 1/1986 | Berkeldes | 126/39 E |

FOREIGN PATENT DOCUMENTS

| | | |
|---|---|---|
| 32524 | 7/1970 | Australia . |
| 39121 | 8/1973 | Australia . |
| 440282 | 1/1927 | Fed. Rep. of Germany . |
| 8517477 | 5/1987 | France . |
| 1364890 | 8/1974 | United Kingdom . |

*Primary Examiner*—Larry Jones
*Attorney, Agent, or Firm*—Christensen, O'Connor, Johnson & Kindness

[57] ABSTRACT

A gas burner comprises a burner skirt (1) supporting a burner head (5) provided with combustion ports (6). A plate (9) notched at the edges allows part of the combustion mixture to escape around the bottom of the burner head and burn to form a retention flame below the main combustion ports (6). The flow of gas to the retention flame is metered by metering apertures formed by the bottom of the burner head and the notches in the plate (9). This construction allows the skirt to be made simply and inexpensively from materials such as mild steel, and to be vitreous enamelled, without sacrificing accuracy of metering of the supply to the retention flame.

4 Claims, 2 Drawing Sheets

GAS BURNER

This invention relates to gas burners of the type used in gas cooker hotplates and hobs.

CROSS-REFERENCE TO RELATED APPLICATIONS

This application is related to European patent application No. 88308140.8 and claims priority from United Kingdom applications 8721743 and 8804155.

BACKGROUND OF THE INVENTION

Such burners normally comprise a burner head supported on a skirt assembly. A combustible mixture of gas and air is supplied to the interior of the skirt, and emerges at combustion ports round the top of the burner head, where it burns.

In many burners, particularly burners using natural gas, the velocity of the combustible mixture as it emerges from the ports is such that the flames tend to lift off from the ports and may be extinguished. One method of preventing this, which is employed in the present invention, is to divert a proportion of the combustible gas/air mixture though large slots at the base of the burner, from which it emerges at a much lower velocity, forming a retention flame which prevents the flames at the burner ports above it from lifting off.

The volume of gas passed to the retention flame is normally between 7 and 23% of the total gas air mixture passing into the burner. Control of this proportion is important, since if the flow is too large the velocity may be such at the retention flame itself lifts off, while if it is too small the retention flame may be insufficient to prevent lifting off of the flames at the burner ports.

The gap between the burner base and the top of the skirt assembly forms a metering orifice which controls the flow of combustible gas to the retention flame. The need for accuracy in metering this flow requires that the top surface of the burner skirt should be very accurately formed, and consequently the skirt has hitherto been made by diecasting in aluminium or aluminium alloy. This is an expensive and inconvenient method, and moreover has the disadvantage that the skirt discolours in use and cannot be protected by coating processes, such as vitreous enamelling.

SUMMARY OF THE INVENTION

An object of the present invention is to provide a design of burner of the kind described above in which the skirt construction is cheaper and more convenient to make, which can be made out of sheet metal such as sheet steel by pressing or spinning, and which, if so desired, can be protected by methods such as vitreous enamelling, and which nevertheless retains accurate metering for the flow of combustible gas mixture to the retention flame.

According to the present invention, a gas burner comprises a burner skirt assembly (1,2) arranged to receive a combustible gas/air mixture and a burner head 5 provided with combustion ports 6 and supported on the skirt assembly, the supporting surface of the skirt assembly being formed so as to allow a metered amount of the gas/air mixture to flow to the outside of the burner head where it ignites to provide a retention flame below the combustion ports, characterised in that the skirt assembly comprises a skirt 1 carrying a plate 10 notched at its periphery, and locating means 10 are provided for locating the burner head so that it cooperates with the notches to provide metering apertures for the retention flame mixture. More particuarly, the invention makes use of a plate notched at its periphery which cooperates with the burner head to provide a set of metering apertures for the retention flame gas mixture. Since a notched plate can be produced cheaply and with high accuracy by various methods, for example by punching, the metering of the gas flow may be maintained without the skirt itself necessarily having to be finished to a very high accuracy. This obviates machining of the skirt, and permits the use of processes such as vitreous enamelling in which it is difficult to maintain tight dimensional tolerances.

BRIEF DESCRIPTION OF THE DRAWINGS

A gas burner according to the invention will now be described by way of example with reference to the accompanying drawings in which.

DESCRIPTION OF THE PREFERRED EMBODIMENTS

Figure 1:
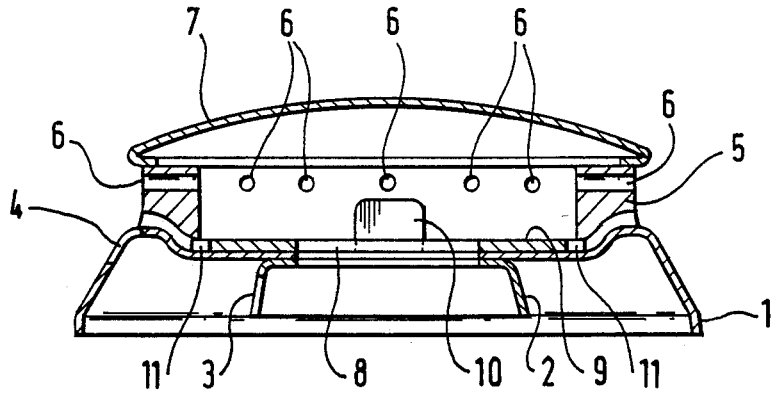
FIG. 1 is an axial section of the burner.
Figure 2:
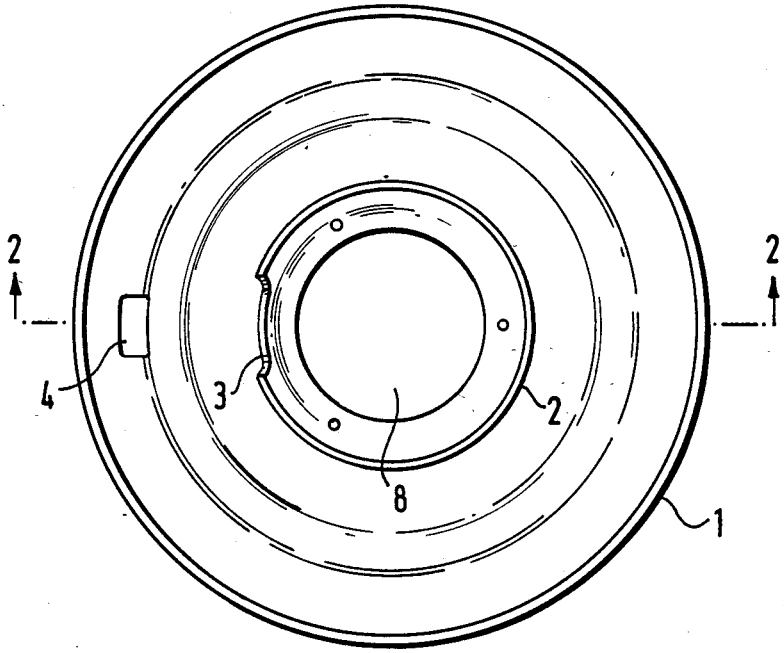
FIG. 2 if an underside view.

Referring first to FIG. 1, the burner comprises a skirt 1 which is located in position on the cooker hob by a locating ring 2. The skirt 1 may be a pressing of sheet metal and the locating ring 2 may be similarly of metal and welded to its underside. A gap 3 in the locating ring and an aperture 4 in the skirt accommodate a pipe (not shown) for ignition purposes.

The burner head 5 is provided with a ring of ports 6 at which the gas air mixture burns, being supplied by a pipe (not shown) which passes up through a central aperture 8 in the skirt assembly. The burner head 5 is closed by a metal cap 7.

On the top of the skirt 1 is a notched metal plate 9 having a pair of upstanding lugs 10. When the burner head is placed on top of the skirt assembly the upstanding lugs 10 help to locate the head in a position such that its lower rim partly covers the notches 11. The gap between the outer bottom edge of the burner head and the roots of the notches from apertures which meter the outflow of gas/air mixture from the interior of the burner to the outside of the burner head where the mixture burns to form the retention flame. The widths and depths of these notches are chosen to suit the particular gas employed, for example natural gas or liquid petroleum gas, so as to give a retention flame of the required dimensions. The notched plate is punched from sheet steel, which enables the notches to be reproduced with high accuracy.

The performance of the burner can be changed to suit different gases as well as different operating conditions by changing the notched plate 9, with no change to the burner skirt. The notches 11 need not all be uniform in size and shape.

The skirt 1 and the skirt locating ring 2 may be metal pressings, for example of mild steel, and the exposed surfaces may be vitreous enamelled.

Figure 3:
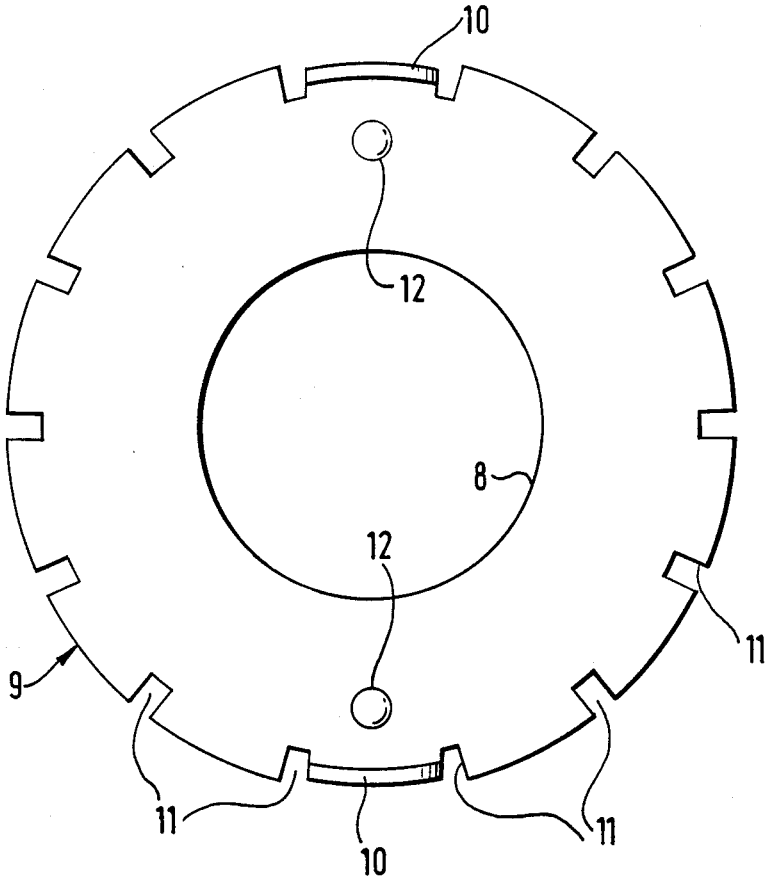
FIGS. 3 and 4 are respectively a plan and elevation of the notched plate employed in the burner of FIGS. 1 and 2.
Figure 4:
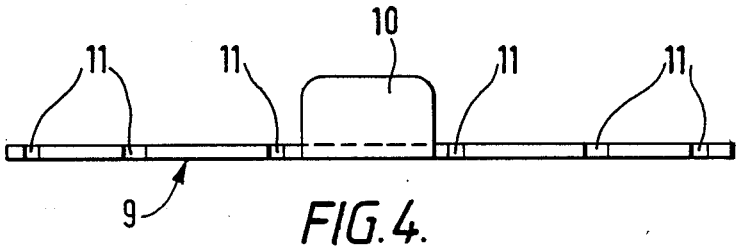

The invention thus provides a simple and inexpensive construction for a burner skirt assembly while at the same time maintaining high accuracy of metering for the flow of combustible gas mixture to the retention flame. Further, the skirt 1 and the notched metal plate 9 may be secured to each other by rivets 12, see FIG. 3.

What is claimed:

1. A gas burner comprising a burner skirt assembly (1, 2) arranged to receive a combustible gas/air mixture and a burner head (5) provided with combustion ports (6) and supported on the skirt assembly, the supporting surface of the skirt assembly being formed so as to allow a metered amount of the gas/air mixture to flow to the outside of the burner head where it ignites to provide a retention flame below the combustion ports, the skirt assembly comprising a skirt (1) carrying a plate (9) of sheet material having a plurality of notches (11) at its periphery, the plate being substantially planar in the region of the notches (11), and locating means (10) being provided for locating the burner head so that it cooperates with the notches to provide metering apertures for the retention flame mixture.

2. A gas burner according to claim 1 in which the locating means comprises upturned lugs (10) on the notched plate.

3. A gas burner according to claim 1 or claim 2 in which the skirt (1) is of sheet metal.

4. A gas burner according to claim 3 in which the skirt (1) is of vitreous enamelled sheet steel.

* * * * *